US010623853B2

(12) United States Patent
Perl

(10) Patent No.: US 10,623,853 B2
(45) Date of Patent: Apr. 14, 2020

(54) MICROPHONE SYSTEM FOR A MOTOR VEHICLE WITH DYNAMIC DIRECTIVITY

(71) Applicant: AUDI AG, Ingolstadt (DE)

(72) Inventor: Martin Perl, Ingolstadt (DE)

(73) Assignee: AUDI AG, Ingolstadt (DE)

( * ) Notice: Subject to any disclaimer, the term of this patent is extended or adjusted under 35 U.S.C. 154(b) by 0 days.

(21) Appl. No.: 16/345,561

(22) PCT Filed: Oct. 17, 2017

(86) PCT No.: PCT/EP2017/076428
§ 371 (c)(1),
(2) Date: Jun. 19, 2019

(87) PCT Pub. No.: WO2018/082912
PCT Pub. Date: May 11, 2018

(65) Prior Publication Data

US 2019/0320259 A1 Oct. 17, 2019

(30) Foreign Application Priority Data

Nov. 2, 2016 (DE) ..... 10 2016 013 042

(51) Int. Cl.
*H04R 1/40* (2006.01)

(52) U.S. Cl.
CPC ..... *H04R 1/406* (2013.01); *H04R 2201/40* (2013.01); *H04R 2410/01* (2013.01); *H04R 2430/20* (2013.01); *H04R 2499/13* (2013.01)

(58) Field of Classification Search
CPC ..... H04R 3/005; H04R 2430/20; H04R 2430/23; H04R 25/407; H04R 2201/401;
(Continued)

(56) References Cited

U.S. PATENT DOCUMENTS 7,231,051 B2 6/2007 Paviot et al.
7,505,901 B2 3/2009 Kaltenmeier et al.
(Continued)

FOREIGN PATENT DOCUMENTS

CN 103918281 A 7/2014
CN 104640001 A 5/2015
(Continued)

OTHER PUBLICATIONS

International Search Report and Written Opinion of the International Searching Authority directed to related International Patent Application No. PCT/EP2017/076428, dated Dec. 21, 2017, with attached English-language translation; 19 pages.
(Continued)

*Primary Examiner* — Alexander Krzystan
(74) *Attorney, Agent, or Firm* — Sterne, Kessler, Goldstein & Fox P.L.L.C.

(57) ABSTRACT

The disclosure relates to a microphone system for a motor vehicle, comprising a microphone housing in which a first microphone, a second microphone and a third microphone are disposed, with a signal processing device, which is designed to process respective signals provided by the microphones, wherein the signal processing device is configured to receive the signals of the first and the second microphones in a first operating mode in such a way that a driver directivity, which is oriented towards a first position of a driver's seat of the motor vehicle is provided, and the signals of the second and third microphones in that a passenger directivity, which is aligned with a first position of a passenger's seat of the motor vehicle is provided in the first operating mode, wherein the signal processing device is configured to process the signals of the first and the third microphones in a second operating mode in such a way that an alternative driver directivity is provided, which is ori-
(Continued)

ented towards a second position of the driver's seat, or to process the signals of the second and third microphones in the second operating mode so as to provide an alternative front seat passenger directivity, which is oriented towards a second position of the front passenger's seat; to minimize a variation in signal quality in the presence of a variation of the size of a driver or front passenger.

10 Claims, 2 Drawing Sheets

(58) Field of Classification Search
CPC ..... H04R 2201/403; H04R 2499/13; H04R 25/405; G10L 2021/02166
USPC ..... 381/71.4, 94.7, 86
See application file for complete search history.

(56) References Cited

U.S. PATENT DOCUMENTS

| | | | | |
|---|---|---|---|---|
| 8,081,772 | B2 | 12/2011 | Turnbull et al. | |
| 9,426,553 | B2 | 8/2016 | Iwai et al. | |
| 9,497,528 | B2 | 11/2016 | Song et al. | |
| 9,712,655 | B2 | 7/2017 | Heo | |
| 10,321,241 | B2 * | 6/2019 | Lunner | H04R 25/402 |
| 2006/0285698 | A1 | 12/2006 | Kong | |
| 2009/0055180 | A1 | 2/2009 | Coon et al. | |
| 2010/0124339 | A1 | 5/2010 | Turnbull et al. | |
| 2016/0014506 | A1 * | 1/2016 | Tanaka | H04R 3/005 381/92 |

FOREIGN PATENT DOCUMENTS

| | | | | |
|---|---|---|---|---|
| DE | 4315000 | A1 | 11/1994 | |
| DE | 10217822 | C1 | 9/2003 | |
| DE | 10339973 | A1 | 3/2005 | |
| DE | 102010034237 | A1 | 10/2011 | |
| DE | 102012023411 | A1 | 6/2013 | |
| DE | 102014013919 | A1 | 3/2016 | |
| DE | 102015220400 | A1 | 6/2016 | |
| EP | 1116961 | A2 | 7/2001 | |
| EP | 1206161 | A1 | 5/2002 | |
| EP | 1475997 | A2 * | 11/2004 | H04M 9/082 |
| EP | 1538867 | A1 | 6/2005 | |
| EP | 1695873 | A1 | 8/2006 | |
| EP | 2146519 | A1 | 1/2010 | |

OTHER PUBLICATIONS

International Preliminary Report on Patentability directed to related International Patent Application No. PCT/EP2017/076428, completed Feb. 12, 2019, with attached English-language translation; 11 pages.

* cited by examiner

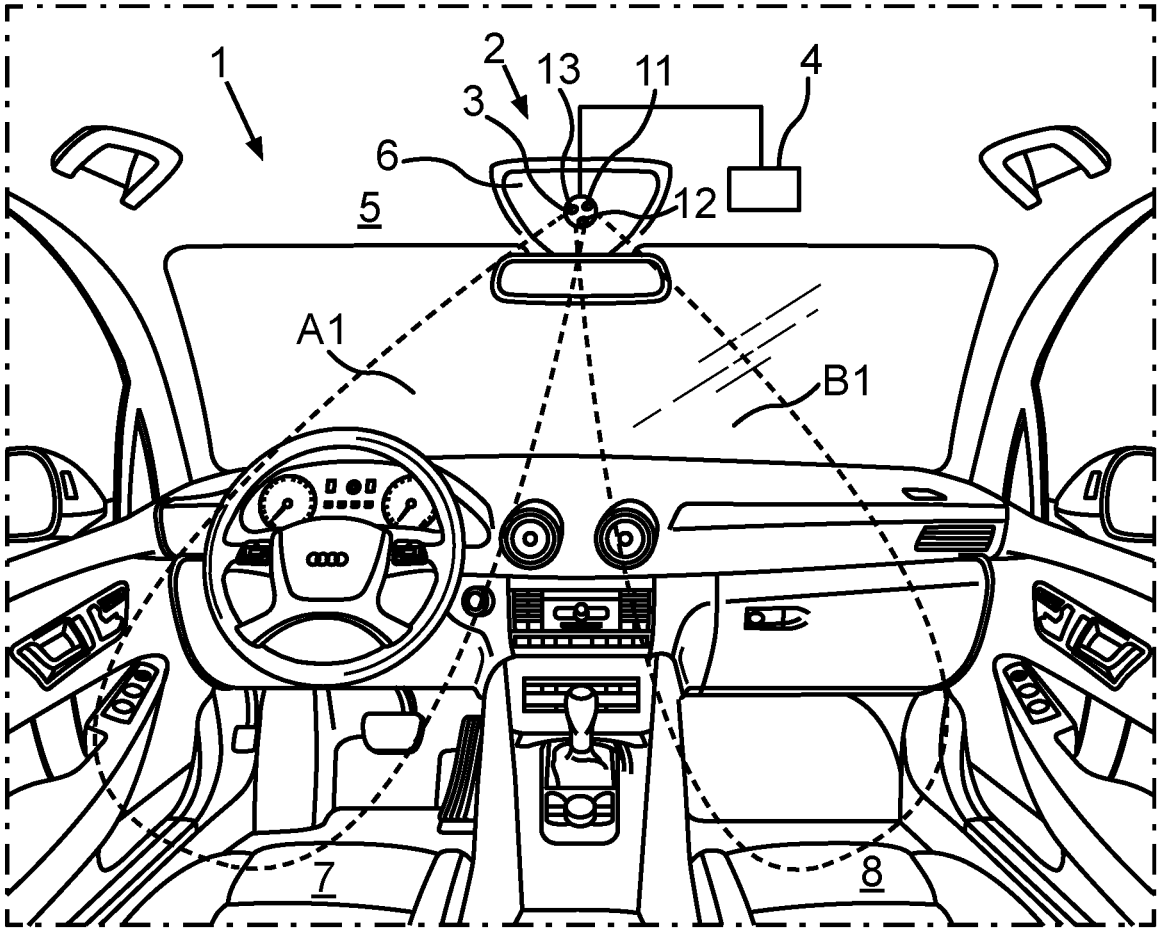
Fig. 1
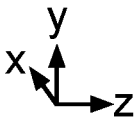

MICROPHONE SYSTEM FOR A MOTOR VEHICLE WITH DYNAMIC DIRECTIVITY

TECHNICAL FIELD

The application relates to a microphone system for a motor and a motor vehicle with such a microphone system. The application furthermore relates to a method for operating a microphone system.

BACKGROUND

A variety of microphones are used today in motor vehicles. A microphone array with four microphones, whereby two microphones each are assigned to a driver or a passenger, is thus known from EP 1 695 873 A1. A noise-compensated hands-free kit in motor vehicles in which two directional microphones are installed in the area of a rearview mirror is known from DE 43 15 000 A1. DE 102 17 822 C1 lastly discloses a method and a device for detecting the viewing direction of a person by means of at least one directionally selective microphone.

DE 10 2014 013 919 A1 discloses a microphone system with three microphones arranged in the form of an isosceles triangle at respective corners of the triangle, in which the signals of the first and the second microphone are processed in such a way that a directivity oriented towards the driver's seat is provided and the signals of the second and third microphones are processed to provide a directivity oriented towards a passenger seat. It has been found that a variation in the size of the driver or the passenger entails an undesirable variation in the quality of the signals provided by the microphone system.

The challenge therefore arises to provide a microphone system for a motor vehicle, in which a variation of the signal quality is minimized in the presence of a variation of the size of the driver or the passenger.

BRIEF DESCRIPTION OF THE DRAWINGS

FIG. 1 shows a motor vehicle with an exemplary embodiment of a microphone system.

DETAILED DESCRIPTION

Figure 2:
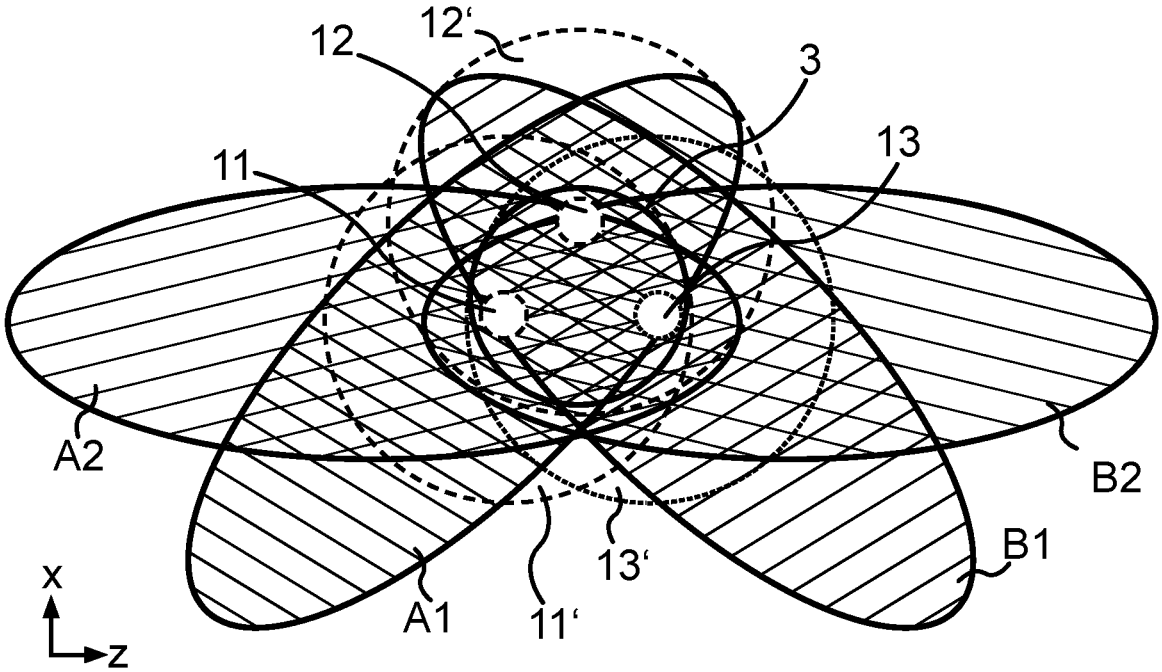
FIG. 2 shows a schematic representation of exemplary directivities of a first exemplary embodiment of a microphone system.

The application relates to a microphone system for a motor and a motor vehicle with such a microphone system. The application furthermore relates to a method for operating a microphone system.

A variety of microphones are used today in motor vehicles. A microphone array with four microphones, whereby two microphones each is assigned to a driver or a passenger, is thus known from EP 1 695 873 A1. A noise-compensated hands-free kit in motor vehicles in which two directional microphones are installed in the area of a rearview mirror is known from DE 43 15 000 A1. DE 102 17 822 C1 lastly discloses a method and a device for detecting the viewing direction of a person by means of at least one directionally selective microphone.

DE 10 2014 013 919 A1 discloses a microphone system with three microphones arranged in the form of an isosceles triangle at respective corners of the triangle, in which the signals of the first and the second microphone are processed in such a way that a directivity oriented towards the driver's seat is provided and the signals of the second and third microphones are processed to provide a directivity oriented towards a passenger seat. It has been found that a variation in the size of the driver or the passenger entails an undesirable variation in the quality of the signals provided by the microphone system.

The challenge therefore arises to provide a microphone system for a motor vehicle, in which a variation of the signal quality is minimized in the presence of a variation of the size of the driver or the passenger.

This problem is solved by way of the subject matter of the independent claims. Advantageous embodiments will become apparent of the dependent claims, the description and the figures.

The application relates to a microphone system for a motor vehicle with a microphone housing, in which a first microphone, a second microphone and a third microphone are disposed, as well as with a signal processing device, which is configured to process the respective signals provided by the microphones. The signal processing device is designed to process the signals of the first and the second microphone in a first operating mode in such a way that a (first) driver directivity oriented toward a first position of the driver's seat of the motor vehicle is provided and/or to process the signals from the second and third microphones in the first operating mode in such a way that a (first) front seat passenger directivity oriented towards a first position of a front passenger's seat of the motor vehicle is provided.

It is important for the signal processing device to be configured to process the signals of the first and the third microphones in a second operating mode so that an alternative (second) driver directivity is provided, which is oriented towards a second position of the driver's seat differing of the first position of the driver's seat, and/or to process the signals of the second and third microphones in the second mode of operation so that an alternative (second) front seat passenger directivity is provided, which is oriented towards a second position of the passenger's seat differing from the first position of the passenger's seat. It is thus possible to use the first or respectively the third unused microphone in the respective first directivity oriented towards the first position of the driver's or the passenger's seat for a driver or front seat passenger directivity so as to produce an alternative directivity, i.e. a second directivity, which has a different orientation than the first directivity. This is possible because the signals of the microphones are present at the same time and can be calculated in digitized form. It is thus possible to predefine a different directivity in each case, for example the first and second driver and front seat passenger directivity, by subtracting or adding the corresponding signals. It is in particular possible to automatically switch between different operating modes, for example the first and the second operating mode. This can be done, for example, by the signal processing device comparing the signals processed into the different driver and/or front seat passenger directivity and detecting with which directivity a better acoustic signal, for example a signal having a more favorable signal-to-noise ratio, can be detected.

This has the advantage that, in the first operating mode, an acoustic signal of the first position of the driver's seat with the corresponding first driver directivity that is optimized for this position can be detected particularly effectively and, at the same time, in a changed position of the driver's seat, for example if a driver moves the seat so as to fit his height, in order to better reach the relevant pedals, an alternative driver directivity can be provided, which optimally detects an acoustic signal of the new position of the driver's seat. The same applies mutatis mutandis for the front seat passenger directivity. This does not require any alteration in the microphone housing and in the microphones themselves, and no additional microphone is needed. An improved microphone system can be implemented at a particularly low cost. With the automatic switching, no external signal from a control element or from another system of the motor vehicle is required for selecting the appropriate directivity, so that, for example, no additional networking of the microphone system with further systems of the motor vehicle is necessary for the extended functionality.

In an advantageous embodiment, it is provided that the three microphones are designed as pressure microphones having an omnidirectivity. This has the advantage that the microphones are particularly low priced and simple. Moreover, it is particularly due to the omnidirectivity of the different microphones in the different operating modes that a very good directivity can be achieved in each case. This would be different, for example, if one or more of the microphones already had a specific directivity, which would, for example, be optimized for the first position of the driver's seat.

In a further embodiment, it is provided that the three microphones are disposed at respective corners of an isosceles triangle, with the second microphone in particular being located at the apex of the triangle. This has the advantage that driver and front seat passenger directivity are disposed symmetrically to each other, so that the microphone housing can be readily positioned in the vehicle so that sounds can be detected equally well at the different positions of the driver's seat and the different positions of the front passenger's seat.

In a particularly preferred embodiment, it is provided that the triangle is an obtuse triangle, in particular with an angle of at least 100 degrees at the apex of the triangle. This has the advantage that a suitable directivity can be provided for the different positions of the driver's and passenger's seats and at the same time a distance between the microphone housing and the driver or passenger seat can be minimized, in particular between the microphone housing and the first position of the driver's seat and the passenger's seat. Sounds can thus be detected particularly well in the different positions of the driver's or the passenger's seat.

In a further advantageous embodiment, the signal processing device is designed to process the signal of the first microphone and a mixed signal of the second and the third microphones in a further operating mode such that a further alternative driver directivity is provided, which is oriented towards a further position of the driver's seat between the first and the second position of the driver's seat. Alternatively or additionally, the signal processing device is designed to process the signal of the third microphone and a mixed signal of the first and the second microphones in a further operating mode so that a further alternative front seat passenger directivity is provided, which is oriented towards a further position of the front passenger's seat between the first and the second position of the front passenger's seat. A virtual signal of another microphone, which is respectively located between the second and the third or the first and the second microphone, is thus generated by means of the mixed signal of the second and the third or of the first and the second microphones. In doing so, the position of the further microphone between the two respective other microphones, i.e. between the second and the third or the first and the second microphone, can be adjusted via an appropriate weighting of the second and the third or the first and the second signal in the respective mixing signal. This can, for example, be achieved by adding the respective signals of the second and the third or respectively of the first and the second microphones, constituting the individual signals of the respective mixed signal, to produce a respective weighted mixed signal. The further alternative directivity can thus be made available from the mixed signal and the respective other signal by means of an appropriate addition or subtraction. The orientation of the further alternative directivity for the passenger's and/or the driver's seats can thus be adjusted by way of a different weighting of the individual signals of the respective two microphones in the mixed signal.

This has the advantage that the passenger and driver directivity can be optimized not only for a first and a second position, but, in principle, for any intermediate positions. Here as well the respective weighting for the individual signals in the mixed signal can be determined automatically, for example by the signal processing device detecting from which direction or respectively by means of which of the different directivities the best acoustic signal is detected. This can be done with little effort without additional microphones, in particular without a hardware-side adjustment of the microphone system, for example, by accordingly processing the digitized signals from the microphone in the signal processing device.

In a further advantageous embodiment, provisions are made for the signal processing device to be configured to further process the signals processed in accordance with a selected driver and/or passenger directivity or an intermediate signal generated therefrom with the signals processed according to another driver and/or front seat passenger directivity and/or to further process a corresponding intermediate signal, so that the selected driver or passenger directivity is improved in that an interference signal related to a different directivity, which signal represents an acoustic background noise, is at least partially, i.e. partially or completely masked out or extinguished by the further processing. This can, in particular, be accomplished by subtracting the processed signals of another directivity from the processed signals or the intermediate signal of the particular selected directivity.

This has the advantage that ambient noises, which are represented by the interference signal and which originate from a position other than the position of the selected directivity, are suppressed. This further improves the quality and flexibility of the microphone system.

In another advantageous embodiment, provisions are made for installing a fourth microphone in the microphone housing and the signal processing device is designed to process the signals of the first and the fourth microphones in a third operating mode in such a way that a further alternative (third) driver directivity is provided, which is aligned with a third position of the driver's seat and/or processes the signals of the fourth and the third microphones in the third mode of operation, so as to provide a further alternative (third) front seat passenger directivity, which is oriented towards a third position of the passenger's seat. The second position of the driver's seat is here disposed between the first and the third positions of the driver's seat and the second position of the passenger's seat is between the first and the third positions of the front passenger's seat. This has the advantage that the flexibility of the microphone system is increased again and it is possible to compensate for a variety of body sizes of the driver or the passenger with appropriate shifts the driver's or the passenger's seats via the additional microphone in the microphone housing.

In a further advantageous embodiment, provisions are made for the first, third and fourth microphones to be disposed in the form of another isosceles triangle at respective corners of the additional triangle, with the fourth microphone located at the apex of the triangle. The geometry is particularly advantageous for detecting the acoustic signal from the driver's and/or front passenger's seat due to the symmetry.

Provisions can preferably be made for the distance of the fourth microphone from the first and the third microphone to be less than the distance of the second microphone from the first and the third microphone. As a result, by processing the signals of the third and fourth microphone with the signal processing device, an additional driver directivity, which, like the first driver directivity, is oriented towards the first position of the driver's seat, can be provided in the first operating mode in addition to the first driver directivity, which is oriented towards the first position. The same applies mutatis mutandis to the first passenger directivity, which is oriented towards the first position of the front passenger's seat, and the processing of the two signals from the first and the fourth microphones. This allows a particularly strong directional effect of the microphone system to be achieved, so that an acoustic signal from the first position of the driver's or passenger's seat can be detected particularly readily. The resulting increased dynamics in the directional sensitivity of the microphone system can also be used to minimize signal quality variations with a driver or passenger size variation.

In a further embodiment, provisions can be made for the signal processing device to be configured to process the signal of the first microphone and a mixed signal of the fourth and third microphones in a further operating mode, so that a further alternative driver directivity, which is oriented towards a different additional position of the driver's seat between the second and the third positions of the driver's seat, is provided and/or to process the signal of the third microphone and a mixed signal of the first and fourth microphones in the different additional operating mode, so that another alternative passenger directivity, which is oriented towards a further position of the front passenger's seat between the second and the third position of the passenger seat, is in turn provided. In this way, in analogy with the further operating mode described above, the microphone system can again be better tailored to different body sizes and usage scenarios with different possible detection directions.

The application also relates to a motor vehicle with a microphone system according to one of the described embodiments.

The application also relates to a method for operating a microphone system of a motor vehicle, with the microphone system comprising a microphone housing, in which a first microphone, a second microphone and a third microphone are disposed, and additionally comprising a signal processing device, which is designed to process the respective signals provided by the microphones and to process the signals of the first and the second microphones in a first operating mode so that a (first) driver directivity oriented towards a first position of a driver's seat of the motor vehicle is provided, and to process signals of the second and third microphones in the first operating mode, so that a (first) front seat passenger directivity oriented towards a first position of a front passenger's seat of the motor vehicle is provided. It is then essential to activate a second operating mode, which is in particular alternative to the first operating mode, in which the signals of the first and the third microphones are processed so that an alternative (second) driver directivity is provided, which is oriented towards a second position of the driver's seat, or in which the signals of the second microphone are processed to provide an alternative (second) front seat passenger directivity oriented towards a second position of the front passenger's seat.

Advantages and advantageous embodiments of the method correspond here to advantages and advantageous embodiments of the microphone system.

Further features of the application will become apparent from the claims, the figures and the description of the figures. The features and feature combinations mentioned above in the description, as well as the features and feature combinations mentioned below in the description of the figures and/or shown only in the figures, can be used not only in the respectively specified combination but also in other combinations without getting out of the scope of the application. Embodiments of the invention, which are however not explicitly shown and explained in the figures, derive from and can be produced by separated combinations of features from the embodiments explained, are thus to be regarded as included and disclosed. Embodiments and combinations of features, which thus do not have all the features of an originally formulated independent claim, are also to be regarded as disclosed. Furthermore, embodiments and combinations of features, in particular through the embodiments set out above, which go beyond or deviate from the combinations of features set out in the back references of the claims, are to be regarded as disclosed.

Figure 3:
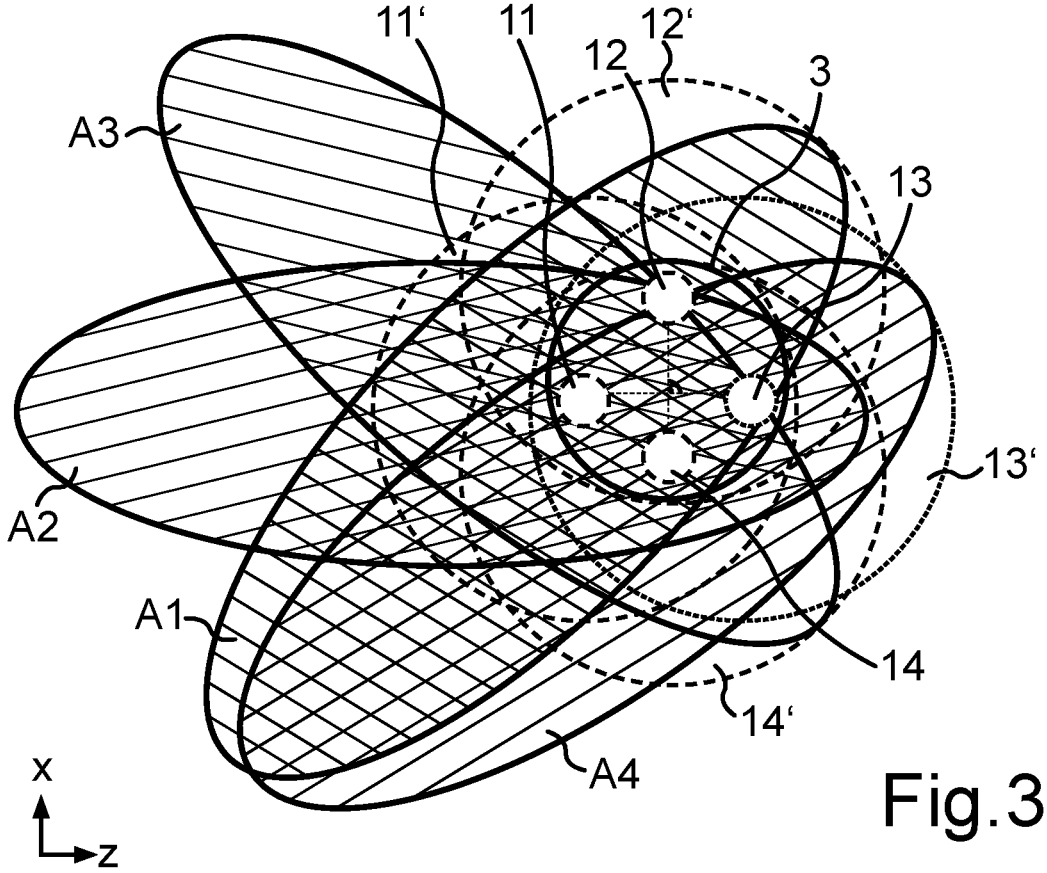
FIG. 3 shows a further schematic representation of a further exemplary directivity of another exemplary embodiment of a microphone system.

Embodiments of the invention are explained in greater detail below with reference to schematic drawings, in which:

FIG. 1 shows a motor vehicle with an exemplary embodiment of a microphone system;

FIG. 2 shows a schematic representation of exemplary directivities of a first exemplary embodiment of a microphone system; and FIG. 3 shows a further schematic representation of a further exemplary directivity of another exemplary embodiment of a microphone system.

Identical or functionally identical elements are provided with the same reference numbers in the figures.

FIG. 1 shows an exemplary embodiment of a microphone system in a motor vehicle. The motor vehicle 1 is shown from an inside perspective. In the example shown, the microphone system 2 comprises a microphone housing 3 with a first microphone 11, a second microphone 12 and a third microphone 13. These microphones are presently disposed in the form of an isosceles triangle at the respective corners of the triangle. The second microphone 12 is here disposed at the apex of the triangle. The microphones are coupled to a signal processing device 4. In the example shown here the microphone housing 3 with the microphones 11, 12, 13 is disposed in a roof liner 5 of the motor vehicle 1, in this case in a roof module 6, which may for example be configured as an interior lighting device.

The signal processing device 4 is now configured to process the signals of the first and second microphones 11, 12 in a first operating mode in such a way that a first driver directivity A1 oriented towards a first position of a driver's seat 7 of the motor vehicle is provided, as well as to process the signals of the second and third microphones 12, 13 so that a first front seat passenger directivity B1 oriented towards a first position of a front passenger's seat 8 of the motor vehicle 1 is provided.

In doing so, the signal processing device 4 is also designed to process the signals of the first and third microphone 11, 13 in a second operating mode so that an alternative second directivity curve A2 (FIG. 2), which is oriented towards a second position of the driver's seat 7, is provided. The signal processing device 4 is alternatively or additionally configured to process the signals of the second and third microphones 12, 13 in the second operating mode, so that an alternative second front seat passenger directivity B2 (FIG. 2), which is oriented towards a second position of the front passenger's seat 8, is provided. It is thus possible to select the appropriate directivity A1, A2, B1, B2, which is best for a respective position of the driver's seat 7 or the passenger's seat 8 relative to the microphone housing 3, for the different positions of the driver's seat 7 or the front passenger's seat 8 respectively. For example, the effect of displacing the driver's or the passenger's seat or seating position in the direction of the vehicle's axis, i.e. in the x-direction in this case, on the detection of an acoustic signal from the corresponding driver's or passenger's seat 7, 8 can thus be reduced, in that the directivity that is suitable for the current position of the driver's or the passenger's seat 7, 8 is selected in each case.

In doing so, the corresponding operating mode having the respective optimal driver or front seat passenger directivity A1, A2, B1, B2 can be automatically selected by the signal processing device 4. To accomplish this, it is, for example, possible to compare the respective signal qualities of the signals processed by the signal processing device 4 to produce the different driver and/or front seat passenger directivities A1, A2, B1, B2 and to thus activate the suitable operating mode.

FIG. 2 shows examples of directivities of the first exemplary embodiment of a microphone system. These microphones 11, 12, 13 each have an omnidirectivity 11', 12', 13'. In addition to the first driver and front seat passenger directivities A1, B2, which are provided or can be generated for the microphone system 2 by way of appropriate processing, such as adding or subtracting the signals of the first and second microphone 11, 12 and/or the third and second microphone 13, 12, this drawing also shows both of the second directivities, i.e. the alternative second driver directivity A2 and the alternative front seat passenger directivity B2. These have an elliptical extent in the example shown. The main axes of the respective directivities A1, B1, A2, B2 run through the respective microphones, i.e. in the case of the first driver directivity A1, through the first and the second microphones 11, 12, and in the case of the first front seat passenger directivity B1, through the second and the third microphones 12, 13, and in the case of the second directivities A2, B2, through the first and the third microphones 11, 13.

The principal axes of the first directivities A1, B1 are tilted in the xy plane relative to the main axes of the second directivities A2, B2, so that the directivities A1, B1, A2, B2 respectively are able to cover different positions of the driver's or the passenger's seats 7, 8. A present position of the driver's or front passenger's seat 7, 8, which lies further forward in the x direction and thus in the travel direction, can thus be better covered by the respective second directivity A2, B2. A better acoustic signal is thus detected by the microphone system 2, even for smaller drivers who push their seats further forward in the travel direction.

The respective other directivity, that is to say, for example the first driver directivity A1 and/or the first passenger directivity B2 and/or the alternative second front seat passenger directivity B2 can be used at the same time to detect interfering noises from the areas associated with these respective directivities A1, B1, B2 in the interior of the motor vehicle 1 and to accordingly eliminate or hide them from the signal detected via the selected directivity A2, while the second driver directivity A2 is used.

FIG. 3 shows a further schematic representation of further example directivities of another exemplary embodiment of a microphone system. For reasons of clarity, the illustrated directivities A1 to A4 are exclusively driver directivities. However, because of the structural and functional geometry, whatever is described below concerning the driver directivity A1 to A4 also applies mutatis mutandis to the corresponding front seat passenger directivities, in which case the first microphone 11 is to be replaced with the third microphone 13.

In the example shown, a fourth microphone 14 is now disposed in the housing 3. In this case, a line passing through the second microphone and fourth microphone 14 intersects a line passing through the first microphone 11 and third microphone 13 at a right angle. The four microphones 11 to 14 can therefore be disposed correspondingly on a diamond or a rhombus. Not only are the three first microphones 11, 12, 13 disposed at respective corners of a triangle in the shape of an isosceles triangle, but also the first, third and fourth microphones 11, 13, 14 in the form of another isosceles triangle with the microphones 11, 13, 14 at the respective corners. As in the example shown in FIG. 2, the respective microphones 11 to 14 have omnidirectivities 11' to 14'. A first driver directivity A1 and a second driver directivity A2 can be provided here as well as in FIG. 2 by means of an appropriate addition and subtraction of the respective signals of the microphones 11 to 14. A third alternative driver directivity A3 can now be provided by means of the fourth microphone 14, by processing the signals of the first and the fourth microphone 11, 14. This third directivity is configured so that a corresponding third position of the driver's seat 7, towards which the third alternative driver directivity A3 is oriented, is disposed in the travel direction, that is to say in the positive x direction, in front of the second driver directivity A2. The second driver directivity A2 is oriented towards the second position of the driver's seat 7 between the first and the third position of the driver's seat 7.

The signal processing device 4 (FIG. 1) in the proposed embodiment may additionally be configured to process the signals of the third microphone 13 and of the fourth microphone 14 in such a way that a fourth driver directivity A4, which is also oriented toward the first position of the driver's seat 7, is provided as an alternative or in addition to the first driver directivity A1. In contrast to the second and third driver directivities A2, A3, which can be provided as an alternative to the first driver directivity A1, provisions are made for the fourth driver directivity A4 to make the latter available in addition to the first driver directivity A1. The signal processing unit 4 can thus particularly readily produce an appropriate signal of particularly high quality for the first position of the driver's seat 7 via the double coverage by the two driver directivities A1, A4.

As also explained with reference to FIG. 2, the signals corresponding to other directivities, in particular the front seat passenger directivities B1, B2 (FIG. 2), can be used by the signal processing device to suppress or filter out corresponding background noises from directions corresponding to the other directivities B1, B2.

The invention claimed is:

1. A microphone system for a motor vehicle, comprising:

a microphone housing in which a first microphone, a second microphone, and a third microphone are disposed; and a signal processing device configured to operate in at least two operating modes, a first operating mode and a second operating mode, the signal processing device being further configured to:

in the first operating mode, process signals from the first microphone and the second microphone to create a driver directivity in producing a driver signal, wherein the driver directivity is an orientation towards a first driver position of a driver's seat of the motor vehicle, and process signals from the second microphone and the third microphone to create a front seat passenger directivity in producing a front seat passenger signal, wherein the front seat passenger directivity is an orientation towards a first passenger position of a front passenger's seat of the motor vehicle;

in the second operating mode, process signals from the first microphone and the third microphone to create an alternative driver directivity in producing an alternative driver signal, wherein the alternative driver directivity is an orientation towards a second driver position of the driver's seat, and process signals from the first microphone and the third microphone to generate an alternative front seat passenger signal based on an alternative front seat passenger directivity, wherein the alternative front seat passenger directivity is an orientation towards a second passenger position of the front passenger's seat; and automatically switch between the first operating mode and the second operating mode based on:

detecting a signal-to-noise ratio of the driver signal and a signal-to-noise ratio of the front seat passenger signal;

detecting a signal-to-noise ratio of the alternative driver signal and a signal-to-noise ratio of the alternative front seat passenger signal;

comparing the signal-to-noise ratio of the driver signal and the signal-to-noise ratio of the alternative driver signal;

comparing the signal-to-noise ratio of the front seat passenger signal and the signal-to-noise ratio of the alternative front seat passenger signal; and switching to the first operating mode if the signal-to-noise ratio of the driver signal exceeds the signal-to-noise ratio of the alternative driver signal, or if the signal-to-noise ratio of the front seat passenger signal exceeds the signal-to-noise ratio of the alternative front seat passenger signal, wherein main axes of the driver directivity, the front seat passenger directivity, the alternative driver directivity and the alternative front seat passenger directivity run through their respective microphones.

2. The microphone system according to claim 1, wherein the first microphone, the second microphone, and the third microphone are omnidirectional pressure microphones.

3. The microphone system according to claim 1, wherein the first microphone, the second microphone, and the third microphone are disposed at the corners of an obtuse isosceles triangle with an angle of at least 100°.

4. The microphone system according to claim 1, wherein the signal processing device is further configured to:

process the signal of the first microphone and a mixed signal of the second microphone and the third microphone in a further operating mode such that a further alternative driver directivity is made available, wherein the further alternative driver directivity is oriented towards a further position of the driver's seat between the first driver position of the driver's seat and the second driver position of the driver's seat; and process the signal of the third microphone and a mixed signal of the first microphone and the second microphone in the further operating mode such that a further alternative front seat passenger directivity is made available, wherein the further alternative front seat passenger directivity is oriented towards a further position of the front passenger's seat between the first passenger position of the front passenger's seat and the second passenger position of the front passenger's seat.

5. The microphone system according claim 1, wherein the signal processing device is further configured to:

process a selected directivity signal according to an interference directivity signal so that the interference directivity signal is partly blocked out from the selected directivity signal.

6. The microphone system according to claim 1, further comprising a fourth microphone disposed in the microphone housing, wherein the signal processing device is further configured to:

process the signals of the first microphone and the fourth microphone in a third operating mode such that a third driver directivity is made available, wherein the third driver directivity is oriented towards a third driver position of the driver's seat or the signals of the fourth microphone and the third microphone in the third operating mode such that a third front seat passenger directivity is made available, wherein the third front seat passenger directivity is oriented towards a third passenger position of the front passenger's seat, wherein the second driver position of the driver's seat is located between the first driver position of the driver's seat and the third driver position of the driver's seat, and the second passenger position of the front passenger's seat is located between the first passenger position of the front passenger's seat and the third passenger position of the front passenger's seat.

7. The microphone system according to claim 6, wherein the first microphone, the third microphone, and the fourth microphone are disposed at respective corners of an another isosceles triangle, with the fourth microphone being positioned at an apex of the other isosceles triangle.

8. The microphone system according to claim 1, wherein the signal processing device is further configured to:

process the signal of the first microphone and a mixed signal of the fourth microphone and the third microphone in a fourth operating mode such that a further alternative driver directivity is prepared, where the further alternative driver directivity is oriented towards a further position of the driver's seat between the second driver position of the driver's seat and a third driver position of the driver's seat or the signal of the third microphone and a mixed signal of the first microphone and the fourth microphone in the fourth operating mode such that a further alternative front seat passenger directivity is prepared, where the further alternative front seat passenger directivity is oriented towards a further position of the front passenger's seat between the second passenger position of the front passenger's seat and the third passenger position of the front passenger's seat.

9. A motor vehicle comprising a microphone system comprising:

a microphone housing in which a first microphone, a second microphone, and a third microphone are disposed; and a signal processing device configured to operate in at least two operating modes, a first operating mode and a second operating mode, the signal processing device being further configured to:

in the first operating mode, process signals from the first microphone and the second microphone to create a driver directivity in producing a driver signal, wherein the driver directivity is an orientation towards a first driver position of a driver's seat of the motor vehicle, and process signals from the second microphone and the third microphone to create a front seat passenger directivity in producing a front seat passenger signal, wherein the front seat passenger directivity is an orientation towards a first passenger position of a front passenger's seat of the motor vehicle;

in the second operating mode, process signals from the first microphone and the third microphone to create an alternative driver directivity in producing an alternative driver signal, wherein the alternative driver directivity is an orientation towards a second driver position of the driver's seat, and process signals from the first microphone and the third microphone to generate an alternative front seat passenger signal based on an alternative front seat passenger directivity, wherein the alternative front seat passenger directivity is an orientation towards a second passenger position of the front passenger's seat; and automatically switch between the first operating mode and the second operating mode based on:

detecting a signal-to-noise ratio of the driver signal and a signal-to-noise ratio of the front seat passenger signal;

detecting a signal-to-noise ratio of the alternative driver signal and a signal-to-noise ratio of the alternative front seat passenger signal;

comparing the signal-to-noise ratio of the driver signal and the signal-to-noise ratio of the alternative driver signal;

comparing the signal-to-noise ratio of the front seat passenger signal and the signal-to-noise ratio of the alternative front seat passenger signal; and switching to the first operating mode if the signal-to-noise ratio of the driver signal exceeds the signal-to-noise ratio of the alternative driver signal, or if the signal-to-noise ratio of the front seat passenger signal exceeds the signal-to-noise ratio of the alternative front seat passenger signal, wherein main axes of the driver directivity, the front seat passenger directivity, the alternative driver directivity and the alternative front seat passenger directivity run through their respective microphones.

10. A method for operating a microphone system of a motor vehicle, wherein the microphone system includes a microphone housing, in which a first microphone, a second microphone, and a third microphone are disposed, and a signal processing device configured to operate in at least two operating modes, a first operating mode and a second operating mode, the method comprising:

in the first operating mode, processing signals from the first microphone and the second microphone to create a driver directivity in producing a driver signal, wherein the driver directivity is an orientation towards a first driver position of a driver's seat of the motor vehicle, and processing signals from the second microphone and the third microphone to create a front seat passenger directivity in producing a front seat passenger signal, wherein the front seat passenger directivity is an orientation towards a first passenger position of a front passenger's seat of the motor vehicle;

in the second operating mode, processing signals from the first microphone and the third microphone to create an alternative driver directivity in producing an alternative driver signal, wherein the alternative driver directivity is an orientation towards a second driver position of the driver's seat, and processing signals from the first microphone and the third microphone to generate an alternative front seat passenger signal based on an alternative front seat passenger directivity, wherein the alternative front seat passenger directivity is an orientation towards a second passenger position of the front passenger's seat; and automatically switching between the first operating mode and the second operating mode based on:

detecting a signal-to-noise ratio of the driver signal and a signal-to-noise ratio of the front seat passenger signal;

detecting a signal-to-noise ratio of the alternative driver signal and a signal-to-noise ratio of the alternative front seat passenger signal;

comparing the signal-to-noise ratio of the driver signal and the signal-to-noise ratio of the alternative driver signal;

comparing the signal-to-noise ratio of the front seat passenger signal and the signal-to-noise ratio of the alternative front seat passenger signal; and switching to the first operating mode if the signal-to-noise ratio of the driver signal exceeds the signal-to-noise ratio of the alternative driver signal, or if the signal-to-noise ratio of the front seat passenger signal exceeds the signal-to-noise ratio of the alternative front seat passenger signal, wherein main axes of the driver directivity, the front seat passenger directivity, the alternative driver directivity and the alternative front seat passenger directivity run through their respective microphones.

* * * * *